US008277565B2

(12) United States Patent
Van Der Bogt

(10) Patent No.: US 8,277,565 B2
(45) Date of Patent: Oct. 2, 2012

(54) METHOD FOR CLEANING TANKS

(75) Inventor: Perry Van Der Bogt, Hoek Van Holland (NL)

(73) Assignee: VCS Global Systems B.V., Ca Rotterdam (NL)

( * ) Notice: Subject to any disclaimer, the term of this patent is extended or adjusted under 35 U.S.C. 154(b) by 0 days.

(21) Appl. No.: 13/127,881

(22) PCT Filed: Nov. 5, 2009

(86) PCT No.: PCT/EP2009/008004

§ 371 (c)(1), (2), (4) Date: May 5, 2011

(87) PCT Pub. No.: WO2010/052020

PCT Pub. Date: May 14, 2010

(65) Prior Publication Data

US 2011/0214693 A1 Sep. 8, 2011

(30) Foreign Application Priority Data

Nov. 7, 2008 (NL) ..... 1036170

(51) Int. Cl.
*B08B 7/04* (2006.01)

(52) U.S. Cl. ..... 134/10; 210/774; 95/241; 95/254; 95/263; 96/155; 134/11; 134/12; 134/19; 134/34; 134/35; 134/37; 134/42; 134/105; 204/157.3; 204/157.9; 204/157.15; 204/158.21

(58) Field of Classification Search ..... 210/774; 95/241, 254, 263; 96/155; 134/10, 11, 12, 134/19, 34, 35, 37, 42, 105; 204/157.3, 157.9, 204/157.15, 158.21
See application file for complete search history.

(56) References Cited

U.S. PATENT DOCUMENTS 3,046,163 A 6/1962 Kearney et al.
5,391,304 A * 2/1995 Lantos ..... 210/774

FOREIGN PATENT DOCUMENTS

GB 470 419 a 8/1937

* cited by examiner

*Primary Examiner* — Bibi Carrillo
(74) *Attorney, Agent, or Firm* — Ladas & Parry LLP

(57) ABSTRACT

Method and apparatus for removing residues of hazardous materials from vapor in a tank (1), wherein such a vapor is heated, passed outside the tank and subsequently cooled and the remaining dry vapor is recirculated, characterized in that a) said vapor is heated to a temperature of at least 5° C. above the melting point and below the self ignition point of the hazardous material, b) the vapor mixture thus formed is passed by means of a pump (3) from the tank through a discharge unit to a recovery unit, c) is cooled to a temperature of at least 5° C. lower and above the melting point of the hazardous material in a recovery unit, d) the liquid components of the vapor are recovered and the dry gas mixture is recirculated to the tank after reheating to the desired temperature, e) said recirculation being repeated as required.

8 Claims, 1 Drawing Sheet

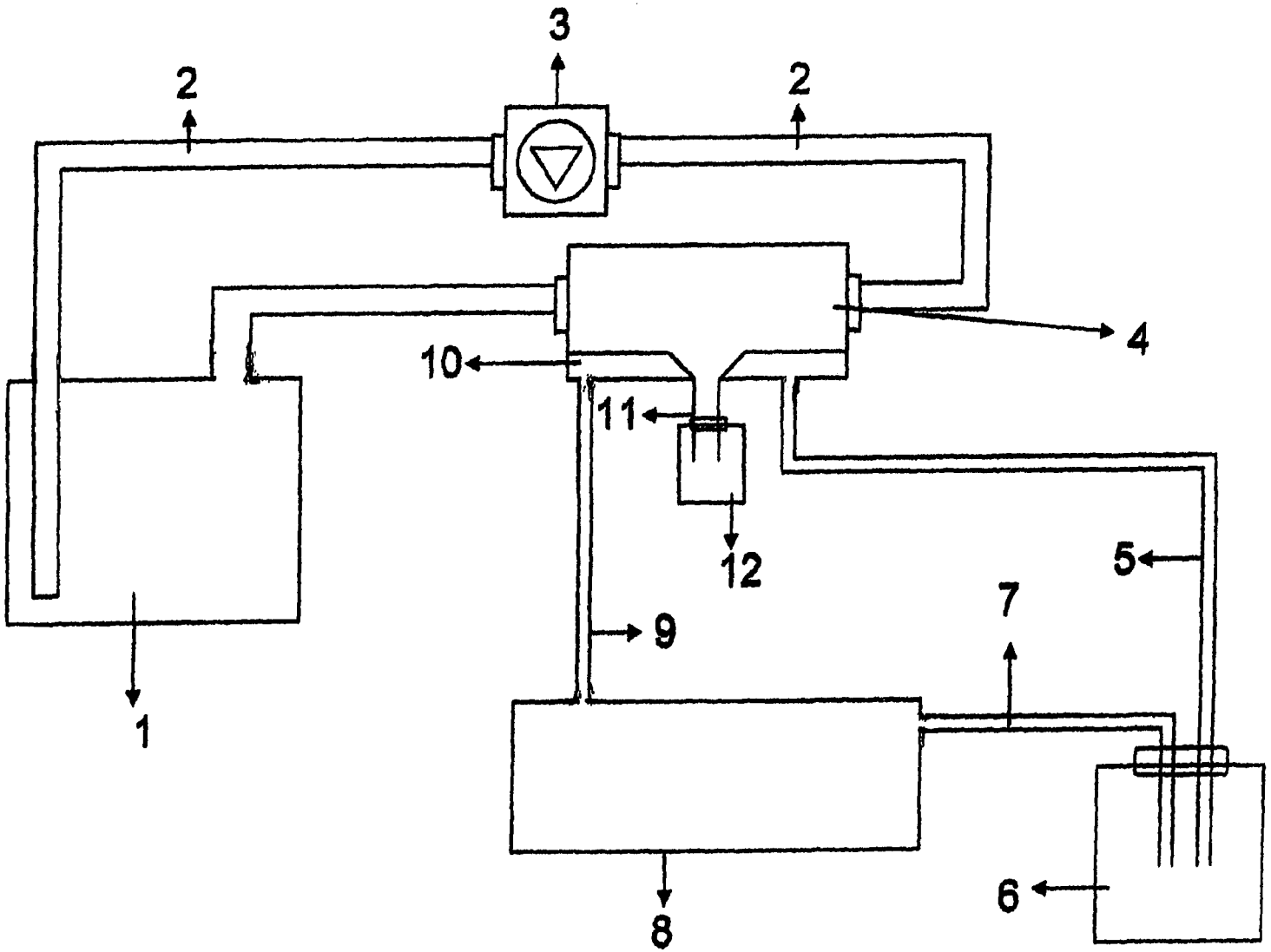
1
2
2
3
4
5
6
7
8
9
10
11
12

METHOD FOR CLEANING TANKS

BACKGROUND OF THE INVENTION

The present invention relates to a method for cleaning tanks, such as storage tanks and ship tanks.

1. Field of the Invention

Hitherto such tanks were vented, in particular after having contained hazardous materials such as benzene. Venting is a time-consuming blower operation, accompanied by development of vapours, which may be hazardous to the environment. Therefore the exciting vapours have to be burned in an incinerator, or alternatively ships have to vent in the open sea. Thus both alternatives are expensive.

2. Description of Related Art

GB-A-470,419 relates to a method and apparatus for cleaning the interior of enclosed spaces such as tank cars, fuel tanks and oil and chemical carrying containers which may have become fouled on their interior surfaces. The method comprises introducing a solvent into the enclosed space in both vapour and liquid form, and removing the liquid solvent containing dissolved impurities from the enclosed space.

U.S. Pat. No. 3,046,163 relates to a method and apparatus for interiorly cleaning a tank by first passing a hot vapour of a chlorinated hydrocarbon solvent into the tank, condensing said vapour on the tank walls, draining off the contaminated condensate and recovering the solvent, followed by pressure spraying the interior with liquid solvent, then again passing hot solvent vapour into the tank and finally passing unheated outside air through the tank to remove remaining traces of solvent vapour from the air.

The above patents both relate to a method for removal of residual material clinging to the walls of a tank, using a suitable solvent and recirculating the recovered solvent until said material has been removed from the walls and apparatus suitable for use in said method.

As both patents expired well over twenty years ago it would have been obvious to use these methods and apparatus as an easy way out to avoid the high costs and environmental damage of the venting system as presently used, but apparently these methods and apparatus were not sufficiently refined to obtain adequate cleaning of tanks.

The above disadvantages are avoided by the method according to present invention.

BRIEF SUMMARY OF THE INVENTION

The present invention provides a method for removing hazardous material from a tank, whereby 90% of the hazardous material are removed from the tank within 1-2 hours.

The present invention provides a method for removing residues of hazardous materials from vapour in a tank, wherein a vapour, comprising hazardous material, present in a tank, is heated, passed outside the tank and is subsequently cooled and the remaining dry vapour is recirculated, characterized in that the vapour comprising hazardous material is heated by appropriate means to a temperature of at least 5° C. above the melting point and below the self ignition point of the hazardous material to be removed, is passed by means of a pump through a cooler, wherein the vapour is cooled by appropriate means to a temperature at least 5° C. lower than the initial temperature and above the melting point of the hazardous material, the liquefied components of the vapour are recovered and the remaining dry vapour is recirculated to the tank, and recirculating being continued until the desired level of hazardous material has been achieved.

In the method described above the vapour is preferably a dry vapour. The pump is required to achieve a high throughput of the vapour, thus reducing the processing time.

In order to make the tank available for further use any possibly remaining undesired material is removed with a scrubber or in another suitable way.

As examples of materials transported in the tank may be mentioned amongst others benzene, petroleum and petroleum products, such as petrol(gasoline), palm oil and olive oil.

BRIEF DESCRIPTION OF THE DRAWING

FIG. 1 shows a sequence of units for carrying out the invention.

DETAILED DESCRIPTION OF THE INVENTION

More specifically the method according to the invention relates to the treatment of benzene and ethanol as hazardous material. The contents of the tank are preheated to the desired temperature level at the start. Preferably benzene vapour is cooled to a temperature above 6° C., or ethanol vapour to a temperature above 4° C., the cooling preferably being performed by means of chilled medium such as water, while the initial vapour is at a temperature between 11° C. and 30° C. for benzene and a temperature between 9° C. and 30° C. for ethanol. Heating is preferably performed by means of appropriately heated medium, such as water.

The hazardous material will condense in the cooling unit (cooler) and can be isolated from there while the remaining vapour is returned to the tank. This treatment is repeated by recirculating the vapour until the desired level of hazardous material is achieved.

With respect to benzene the vapour may be cooled to below the solidification point of benzene, 5,5° C., in a final recirculation step.

In the following the invention is further elucidated with references to the drawing, in which the sequence of units for carrying out the method according to the invention for a tank is shown schematically.

A vapour, heated to a suitable temperature by heating means (not shown), is passed from a tank 1 to a cooler 4 via a conduit 2 by means of a pump 3. Said cooler is provided with a jacket 10 (only the lower part being shown). Condensed vapour is discharged from the cooling unit 4 to collector 12 by means of conduit 11. Cooling unit 8 provides cooling medium to the jacket 10 of cooler 4 via conduit 9, said cooling medium being returned to the cooler 8 via collecting vessel 6 and conduits 5 and 7. The remaining vapour in the cooler 4 is returned to the tank 1 via the last part of conduit 2. All conduits may consist partially or completely of flexible hoses.

Having thus described the present invention, it will be understood by those skilled in the art that variations and modifications can be effected in the described embodiments without departing from the scope and spirit of the invention.

The invention claimed is:

1. A method for removing hazardous materials from vapour in a tank, the hazardous materials having a melting point and a self ignition point, wherein at an initial temperature, the vapour comprising hazardous materials, present in the tank, is heated by a heating means, the vapour thus formed is passed outside the tank by means of a pump through a cooler, wherein the vapour is cooled, liquefied components of the vapour comprising said hazardous materials are isolated and removed, and remaining dry vapour is recirculated to the tank, recirculating being continued until a desired level of hazardous material has been removed, characterized in that the vapour comprising hazardous material is heated in the tank to a temperature of at least 5° C. above the melting point and below the self ignition point of the hazardous material to be removed, the vapour is cooled in the cooler to a temperature of at least 5° C. lower than the initial temperature and above the melting point of the hazardous material and the remaining dry vapour comprising hazardous material is reheated in the tank to a temperature of at least 5° C. above the melting point and below the self ignition point of the hazardous material.

2. A method according to claim 1, further comprising a final step wherein any remaining undesired hazardous materials are removed with a scrubber.

3. A method according to claim 1, wherein the hazardous material is benzene.

4. A method according to claim 3, wherein benzene is cooled to a temperature above 6° C.

5. A method according to claim 3, wherein the cooling is performed by means of chilled water.

6. A method according to claim 3, wherein the temperature of the benzene being passed outside the tank is at a temperature between 11° C. and 30° C.

7. A method according to claim 6, wherein the heating is performed by heated water.

8. A method according claim 7, wherein the temperature of the vapour before being passed outside the tank is between 9° C. and 30° C.

* * * * *